US006446851B1

(12) United States Patent
Parks et al.

(10) Patent No.: US 6,446,851 B1
(45) Date of Patent: Sep. 10, 2002

(54) PORTABLE, ORGANIZED SPORTING EQUIPMENT CARRIER

(75) Inventors: Gerald R. Parks; Donald J. Widmer, both of Chula Vista, CA (US)

(73) Assignee: JT USA, Inc., Chula Vista, CA (US)

( * ) Notice: Subject to any disclaimer, the term of this patent is extended or adjusted under 35 U.S.C. 154(b) by 0 days.

(21) Appl. No.: 09/799,893

(22) Filed: Mar. 7, 2001

(51) Int. Cl.[7] ..... A45F 3/04

(52) U.S. Cl. ..... 224/655; 224/153; 190/111; 190/125; 383/38

(58) Field of Search ..... 224/153, 655, 224/237; 190/113, 114, 901, 902, 111, 124, 125, 127; 150/127, 129, 130; 383/38

(56) References Cited

U.S. PATENT DOCUMENTS 1,206,276 A * 11/1916 Wallach ..... 190/109
1,838,869 A * 12/1931 Rieb ..... 190/115
2,623,566 A * 12/1952 Kibler ..... 190/125
4,236,657 A * 12/1980 Brunton ..... 190/111
4,925,021 A * 5/1990 Pulichino, Jr. ..... 190/109
5,052,555 A * 10/1991 Harmon ..... 190/111
5,918,711 A * 7/1999 Godshaw ..... 190/107
6,193,034 B1 * 2/2001 Fournier ..... 190/107
6,193,118 B1 * 2/2001 Kearl ..... 108/43

* cited by examiner

*Primary Examiner*—Gregory M. Vidovich
(74) *Attorney, Agent, or Firm*—Henri J.A. Charmasson; John D. Buchaca

(57) ABSTRACT

A portable, organized carrier for holding a variety of odd-sized goods includes two sets of layered, co-nesting, pocket-mounting flaps foldable around a comparted core area. The folded flaps are capped and clamped together by a pair of shell-like covers mounted at opposite longitudinal ends of the carrier. Shoulder and waist straps as well as a handle allow for use of the carrier as a backpack or a tote bag.

11 Claims, 2 Drawing Sheets

PORTABLE, ORGANIZED SPORTING EQUIPMENT CARRIER

FIELD OF THE INVENTION

This invention relates to backpacks, tote bags and luggage made of fabric or other pliable material, and, more specifically, to portable carriers designed to house a variety of odd-sized goods.

BACKGROUND OF THE INVENTION

The designers of luggage pieces, tote bags, backpacks and similar devices which are intended to house a variety of goods of different shapes must strive to provide the maximum holding capacity within a limited space. If the contents of the carrier have to be held in separate compartments, the designers are faced with the additional problems of space and location assignment for each holding component of the carrier. The designers tasks are further complicated when the contents include items of vastly different nature, size, shape, and weight. Moreover, in many cases, the user must be able to quickly and conveniently retrieve any particular item from the container without having to handle and disturb other items. If the carrier is made of solid material such as a tool box, the most common approach has been to provide a plurality of compartments and drawers that are distributed over one or more sides of the carrier. In cases where the carrier is made of fabric or other soft, pliable material, the use of drawers is not possible. Compartmental organization must be achieved by means of an unrolling web upon which a plurality of pockets have been mounted, or the formation of pockets and holding stations by a judicious arrangement of pliable septi.

This invention results from attempts to provide sports enthusiasts, and particularly those who must have quick access to a variety of implements, with a highly organized carrier that allows easy access to any piece of equipment.

SUMMARY OF THE INVENTION

The principal and secondary objects of this invention are to provide a compact and lightweight carrier capable of holding a large variety of objects of different sizes and shapes in separate compartments that can be quickly and conveniently accessed in order to retrieve a particular item without having to shuffle through, handle, or displace any other item in the carrier.

These and other valuable objects are achieved by a portable carrier made essentially of pliable fabric in which two sets of layered, co-nesting and pocket-mounting flaps are folded around a comparted central area, the folded flaps are capped by shell-like end pieces mounted at opposite longitudinal ends of the carrier. Once the end pieces are spread open, the various flaps present themselves like the pages of a book which can be conveniently turned to provide access to pockets and straps distributed over the faces of each flap, as well as to the central area which is also subdivided in a plurality of separate holding stations.

DESCRIPTION OF THE PREFERRED EMBODIMENT OF THE INVENTION

Figure 2:
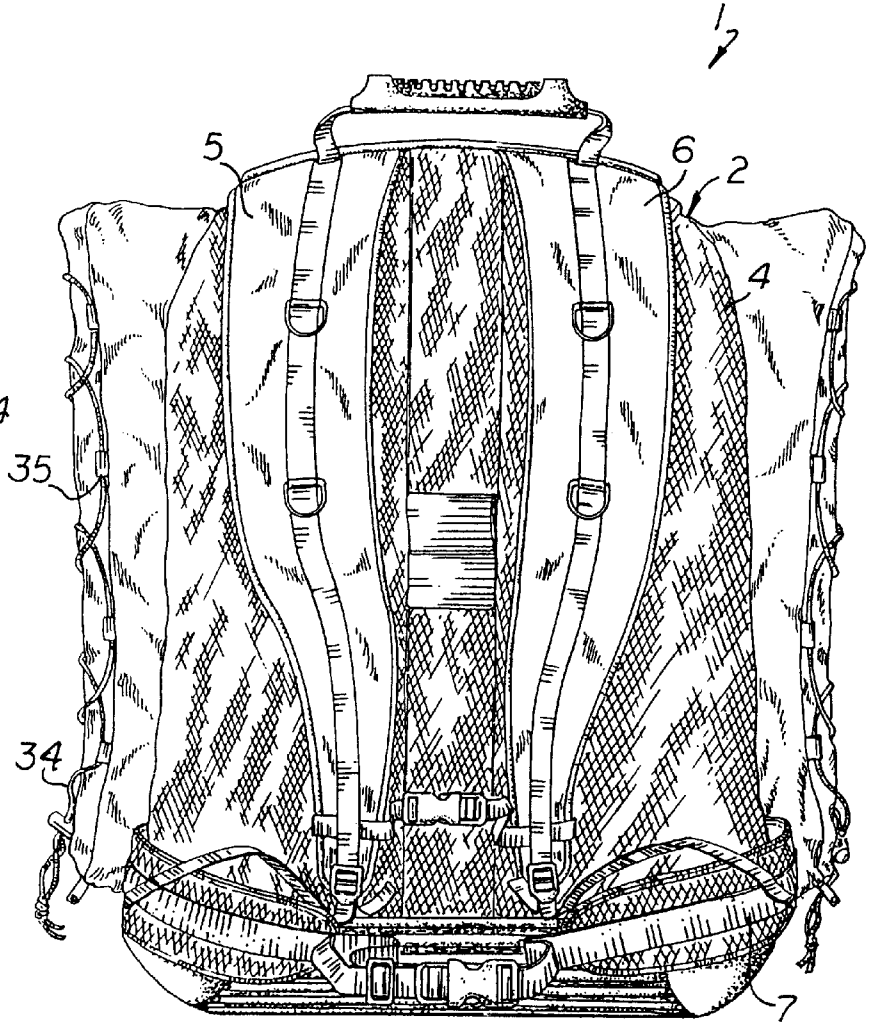
FIG. 2 is a back elevational view thereof.
Figure 1:
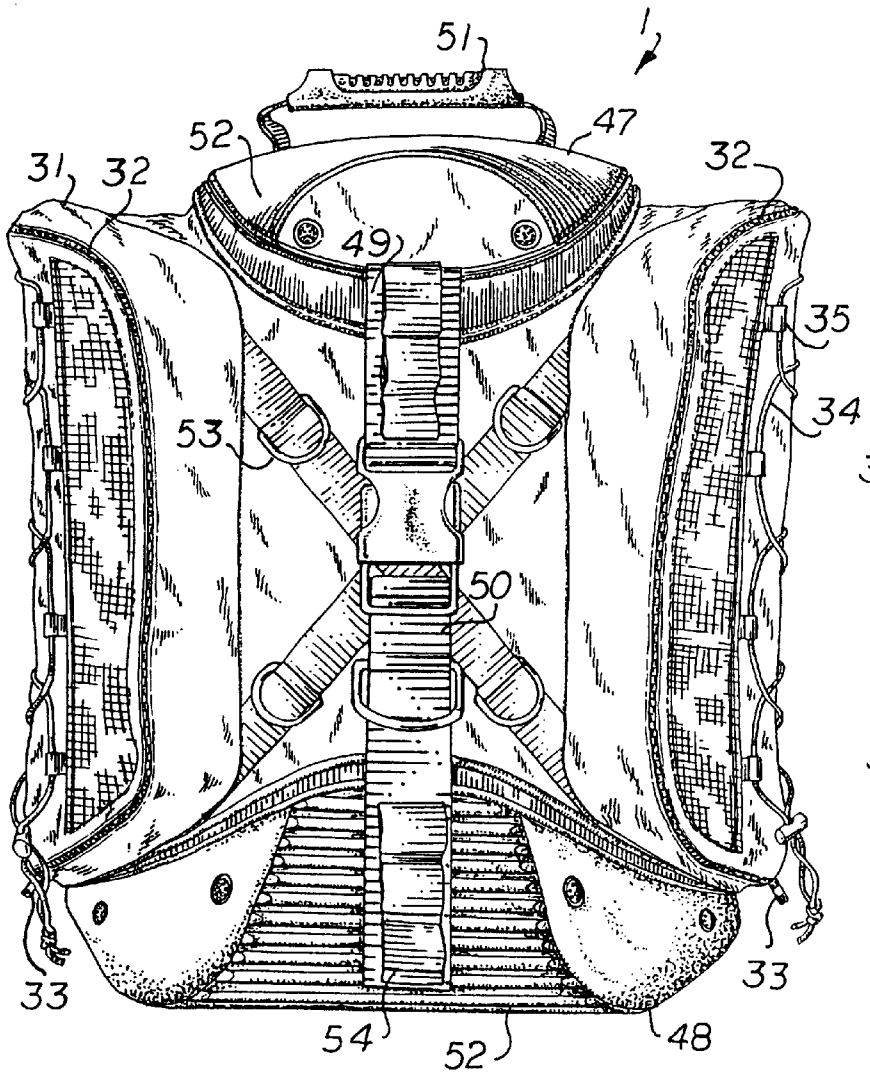
FIG. 1 is a front elevational view of a carrier according to the invention.

Referring now to the drawing, there is shown a portable carrier 1 built according to the invention. This carrier is specifically designed to hold equipment used in the practice of paint-ball war games. Although it is configured for a particular purpose, the carrier could be used for holding a variety of goods and wearing apparels or, with minor modifications, as a generic piece of luggage.

Figures 3, 4, 5:
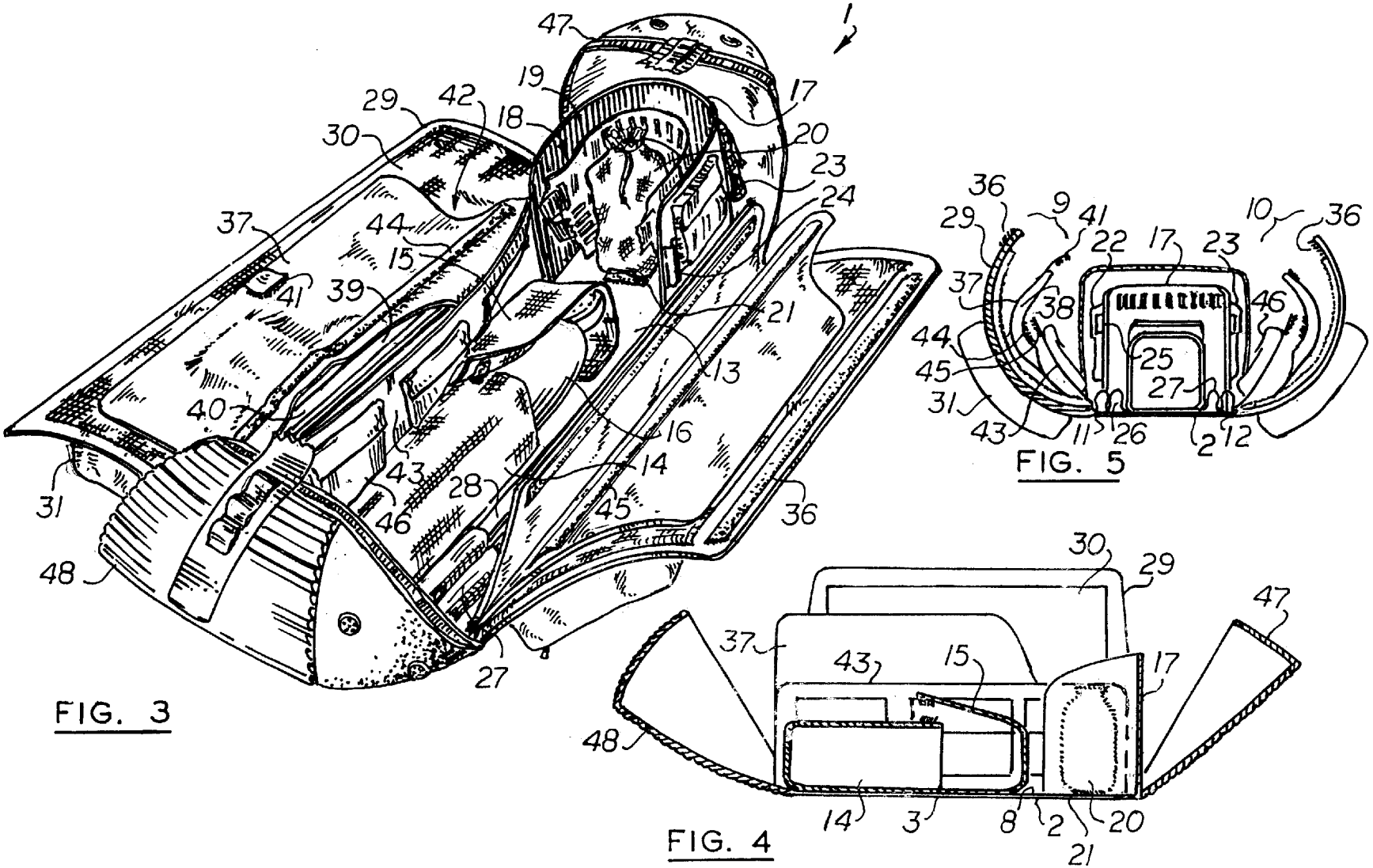
FIG. 3 is a perspective view thereof in the open configuration.
FIG. 4 is a schematical, longitudinal, median, cross-sectional view thereof.
FIG. 5 is a schematical, transversal, median, cross-sectional view thereof.

The carrier 1 is built around a backplate 2 made of solid but flexible material. The outer face 3 of the backplate is padded by a mesh-fabric-lined layer of spongy material 4. The flexible and padded backplate forms a comfortable dorsal plate when the carrier is used as a backpack, and is secured to a person's back by way of a set of shoulder straps 5 and 6, chest strap (as seen in FIG. 2), and waist belt 7. A variety of good-holding elements are mounted on the inner face 8 of the backplate. Two identical sets 9, 10 of flaps are secured to opposite lateral borders 11, 12 of the backplate inner face. The flaps are made of fabric-lined slabs of foam material and are, therefore, pliable. In each set, the flaps are secured together along one longitudinal edge, and hingedly connected to the backplate lateral border. As more specifically illustrated in FIG. 5, the flaps present themselves like the pages of a book of which the backplate acts as the spine.

A Mounted against the central area 13 of the inner face of the backplate are several good-holding structures. First, an oblong pocket 14 with a cover flap 15 is shaped and dimensioned to hold a compressed gas canister 16. Next to the pocket is an arcuate wall projecting orthogonally from the inner face of the central area. The recess formed by the arcuate wall is dimensioned to receive either a face mask 19, goggles or similar bulky object. A bag made of netting fabric particularly convenient for housing a headband, gloves, socks, or other similar article is detachably held in the center of the recess by patches of hook-and-vane fabric fasteners 21. Pockets 22, 23 and loops of fabrics 24, 25 are mounted on the arcuate walls, and may be used for holding a variety of small items. Several loops of fabric 26, 27 are also mounted directly against the inner face of the backplate. Those loops can be used for securing gun barrels 28 or similarly-shaped objects.

In each set of flaps 9, 10, a first external one 29 forms a cover or outer wall of the carrier. A pocket 30 made of netting material lines the inner face of each external flap. A larger pocket 31 is formed against the outer face of the flap. The outer pocket is accessed through a longitudinal slit 32 equipped with a slide fastener 33. A string 34 laced through sets of loops 36 mounted against the outer wall of the pocket can be used for holding a piece of clothing. The two external flaps 29 can be brought together and secured to each other along their external longitudinal edges by cooperating patches of hook-and-vane fabric fasteners 36.

In each set of flaps, a central one 37 forms a pouch 38 having a longitudinal opening 39 facing the back plate. This pouch is specifically dimensioned to house a paint-ball gun 40. The central flaps from both sets can be brought together and secured to each other by means of a strap 41 also provided with hook-and-vane fabric fasteners. While the outer flaps are shaped and dimensioned to wrap around the arcuate wall 17, the central flaps have cut out portions which allows their free edges to meet and be tied together below the uppermost level of the arcuate wall.

In each set, an inner flap 43 acts as a cover for the opening 40 of the central flap pouch to which it can be secured by strips of cooperating hook-and-vane fabric fastener 44, 45. A series of pockets 46 are mounted against the inner wall of the inner flaps. Accordingly, each pair of flaps can be folded toward each other astride the central area to form a very compact and secure means for holding a great variety of objects and equipment.

A cap piece 47, 48 is mounted at each longitudinal border of the backplate. The cap pieces can be folded toward each other and over the opposite top and bottom edges of the folded sets of flaps, then secured together by means of buckle-mounting straps 49, 50 to secure the entire carrier. A handle 51 is provided at the juncture of the top cap piece 47 and the backplate 2 in order to allow lifting the carrier in the manner of a tote bag. The external surface of the two caps are lined with strips 52 of wear-resistant, ribbed padding material. A variety of D-rings 53 and loops 54 of fabric ribbons are provided on the outer walls of the carrier for convenient attachments of other implements.

While the preferred embodiment of the invention has been described, modifications can be made and other embodiments may be devised without departing from the spirit of the invention and the scope of the appended claims.

What is claimed is:

1. A portable carrier for holding a variety of goods which comprises:

a substantially flat back-plate having inner and outer faces, first and second opposite lateral borders, a top border, a bottom border opposite said top border, and a central good-holding area;

a first set of a plurality of pliable flaps, each of said flaps being hingedly secured along one edge to said first lateral border;

a second set of a plurality of pliable flaps, each of said flaps being hingedly secured along an edge to said second lateral border; wherein each of said flaps includes means shaped and dimensioned for holding at least one object; and means for holding said sets of flaps folded toward each other astride said central area.

2. The carrier of claim 1 which further comprises:

a first cap piece hingedly connected to said bottom border;

a second cap piece hingedly connected to said top border; and means for holding said cap pieces folded toward each other over opposite top and bottom edges of said folded sets of flaps.

3. The carrier of claim 2 which further comprises means, associated with said central area, for housing at least one object.

4. The carrier of claim 2, wherein said means for holding at least one object comprise pockets formed over said flaps.

5. The carrier of claim 4, wherein said pockets comprise at least one pouch having an opening facing said backplate.

6. The carrier of claim 3, wherein said means for housing comprise at least one pocket secured to said central area.

7. The carrier of claim 3, wherein said means for housing comprise at least one container detachably secured to said central area.

8. The carrier of claim 4 which further comprises means for handling said carrier.

9. The carrier of claim 8, wherein said means for handling comprise a plurality of straps secured to said outer face, sized and dimensioned to mount said carrier over a person's back.

10. The carrier of claim 3, wherein said means for housing comprises a wall projecting orthogonally from said cental area; and at least one pocket mounted against a face of said wall.

11. The structure of claim 5, wherein two of said flaps are detachably held together to close said pouch opening.

* * * * *